United States Patent [19]

Nishio

[11] 4,035,958

[45] July 19, 1977

[54] MOBILE FLOOR CLEANING AND POLISHING DEVICE

[75] Inventor: Takuji Nishio, Tokyo, Japan

[73] Assignee: Tokyo Kosei Kaken Co. Ltd., Tokyo, Japan

[21] Appl. No.: 595,114

[22] Filed: July 11, 1975

Related U.S. Application Data

[63] Continuation-in-part of Ser. No. 440,057, Feb. 6, 1974, abandoned.

[30] Foreign Application Priority Data

Mar. 30, 1973 Japan ..... 48-36509

[51] Int. Cl.[2] ..... B24C 3/00

[52] U.S. Cl. ..... 51/425; 51/429

[58] Field of Search ..... 51/8 R, 9 M, 174

[56] References Cited

U.S. PATENT DOCUMENTS

| | | | |
|---|---|---|---|
| 3,380,196 | 4/1968 | Mabille | 51/9 M |
| 3,566,543 | 3/1971 | Fogle | 51/9 M |
| 3,691,689 | 9/1972 | Goff | 51/8 X |
| 3,877,175 | 4/1975 | Snyder | 51/9 M |
| 3,916,568 | 11/1975 | Rose et al. | 51/9 M X |

*Primary Examiner*—James L. Jones, Jr.
*Assistant Examiner*—James G. Smith
*Attorney, Agent, or Firm*—Otto John Munz

[57] ABSTRACT

A mobile floor cleaning and polishing machine comprising a wheel-supported chassis having thereon a turntable rotatable about a normally vertical axis. The turntable supports abrasive-ejecting mechanism including a generally rectangular nozzle from which granular, pelleted or pulverous abrasive may be discharged at high velocity, downwardly against the floor or other surface to be cleaned. By adjusting the angle of the rectangular nozzle with respect to the direction of advance of the machine, the width of the area treated in a single pass of the machine, may be controlled as desired. Spent abrasive is automatically recovered, cleaned and stored for re-use. Means are disclosed for oscillating the ejector means back and forth relatively to the chassis, in the direction of travel of the machine.

16 Claims, 9 Drawing Figures

MOBILE FLOOR CLEANING AND POLISHING DEVICE

CROSS REFERENCE TO RELATED APPLICATIONS

This application is a continuation in part of application Ser. No. 440,057, filed Feb. 6, 1974 now abandoned, and entitled to priority of the corresponding Japanese patent application Ser. No. 48/36509, filed Mar. 30, 1973.

FIELD OF THE INVENTION

The invention relates to a mobile wheel-supported machine for cleaning and polishing floors and other generally horizontal surfaces by the controlled projection against the surface, of pelleted, granular or pulverous abrasive material. Class 51, Subclass 9.

DESCRIPTION OF THE PRIOR ART

In numerous industries there are large floor or deck areas as of wood, concrete, steel and other mterials, which must be periodically cleaned and polished or painted in order to maintain them in satisfactory working condition. Such cleaning procedures often involve the removal of scale, rust, rubber, paint and other undesired and undesirable accumulations adherent to the surface. Among common uses are the removal of rubber built up on airplane landing strips, the scouring of rust and/or paint from a steel floor or from the deck of a ship, erasing guide markings and stripes painted on pavement, cleaning wooden floors preparatory to finishing, and many others.

Usually such procedures have heretofore been carried out by workmen using wire brushes, scrapers, disk or belt sanders, solvents, etc. These are necessarily time-consuming, excessively expensive and generally unsatisfactory due to non-uniform results. Where prior art machines are used for sandblasting there is usually a serious disadvantage because of dust pollution of the ambient air, the necessary use of air-filtering accessories by operating personnel, loss of scouring material and excessive cost due to necessary safety precautions for workmen and the general public.

SUMMARY OF THE INVENTION

The invention solves many of the problems in sandblasting and similar types of cleaning, by providing in a single power-driven and power-operated mobile machine, means for cleaning a strip of surface by moving the machine continuously in the direction of its longitudinal axis while at the same time blasting against the surface, at high speed, abrasive, pelleted, granular or pulverous material.

An important purpose is to provide a construction by which the effective width of the strip treated can be controlled and adjusted, as in the removal from pavement, decks or floors of marking and guide stripes painted or otherwise applied thereto. By such control the unnecessary treatment of areas adjacent to such stripes is avoided with consequent saving of time, abrasive material and power.

A further object is to provide a machine as aforesaid wherein the function of varying the effective width of a strip or area treated in a single pass of the machine thereover, is accomplished by a simple and quick adjustment in the machine, and without the need as in prior art devices, of substituting blasting nozzles of various sizes and shapes of their material-discharge openings.

Still another object is a machine of the aforesaid type which recovers all or a substantial percentage of the abrasive material, accumulates the same, cleans it and stores it for prompt re-use. By this means, dust pollution of the ambient air is avoided, a minimum supply of abrasive is required to be initially charged into the machine, the cost of treatment per unit area is kept to a minimum, the machine may be made in a form less bulky for any given capacity or service, and its efficiency is enhanced because of the increased area capable of being treated before recharging becomes necessary.

Another object is a machine of the type mentioned, which can be adjusted to treat or clean a strip of surface of width selected from a minimum to a maximum in accordance with the conditions and requirements of each particular job, for instance as where a relatively narrow strip only is to be erased from a surface or, on the other hand, where an entire floor or area is to be treated by repeated spaced passes of the machine thereover.

It is an important object to afford a machine as foresaid, capable of repeated passes over any particular area of limited extent and which requires special treatment, while the machine is temporarily at rest or even in continued motion in the direction of its longitudinal axis.

The machine of the present invention is relatively simple to operate, efficient in its use of abrasive materials, capable of use with a wide range of pelleted, granular or pulverous cleaning and scouring materials, efficient in recovery of such materials, and effective in the handling and storage for prompt re-use, of projected and recovered materials. Its use makes unnecessary elaborate precautions against contamination and pollution of the ambient air as is commonly required by the use of prior art machines and devices.

Other objects and advantages will become apparent to those skilled in the art, after a study of the following detailed description, in connection with the accompanying drawing.

DESCRIPTION OF THE PREFERRED EMBODIMENTS

Figure 1:
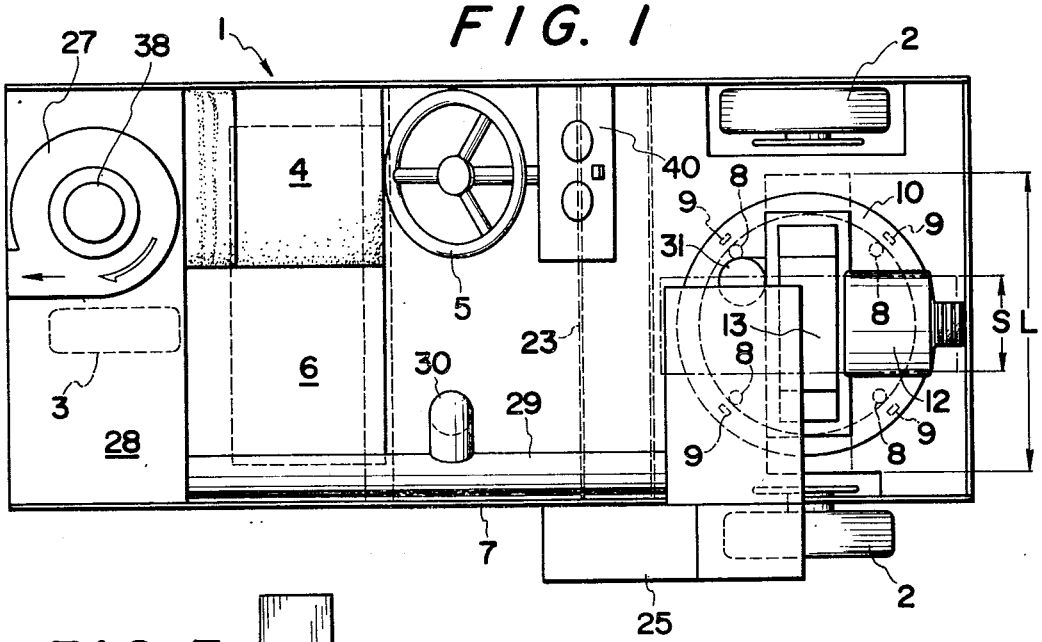
FIG. 1 is a plan view of a machine embodying one form of the invention.
Figure 3:
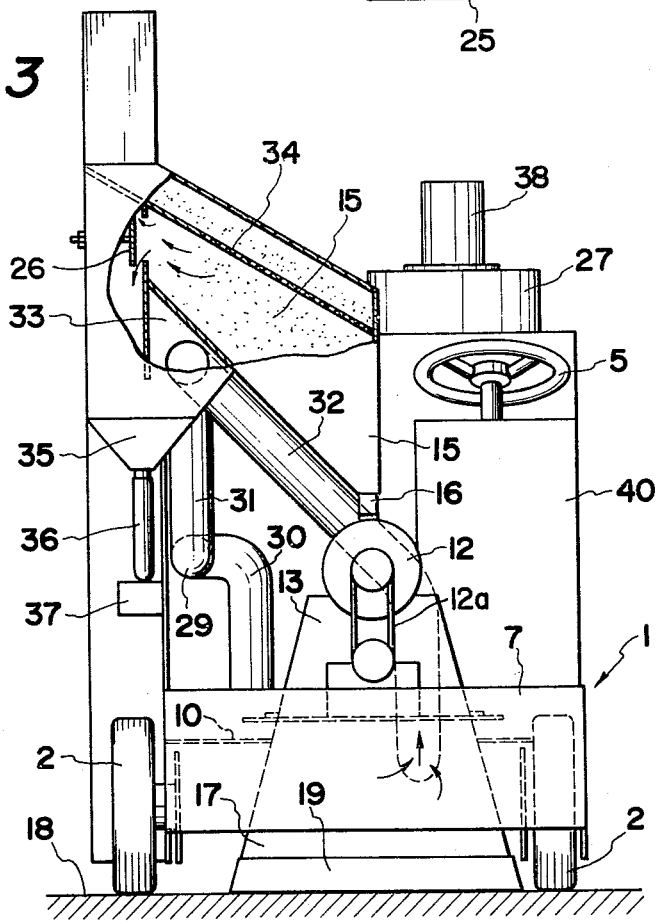
FIG. 3 is a front elevation of the same machine.
Figure 2:
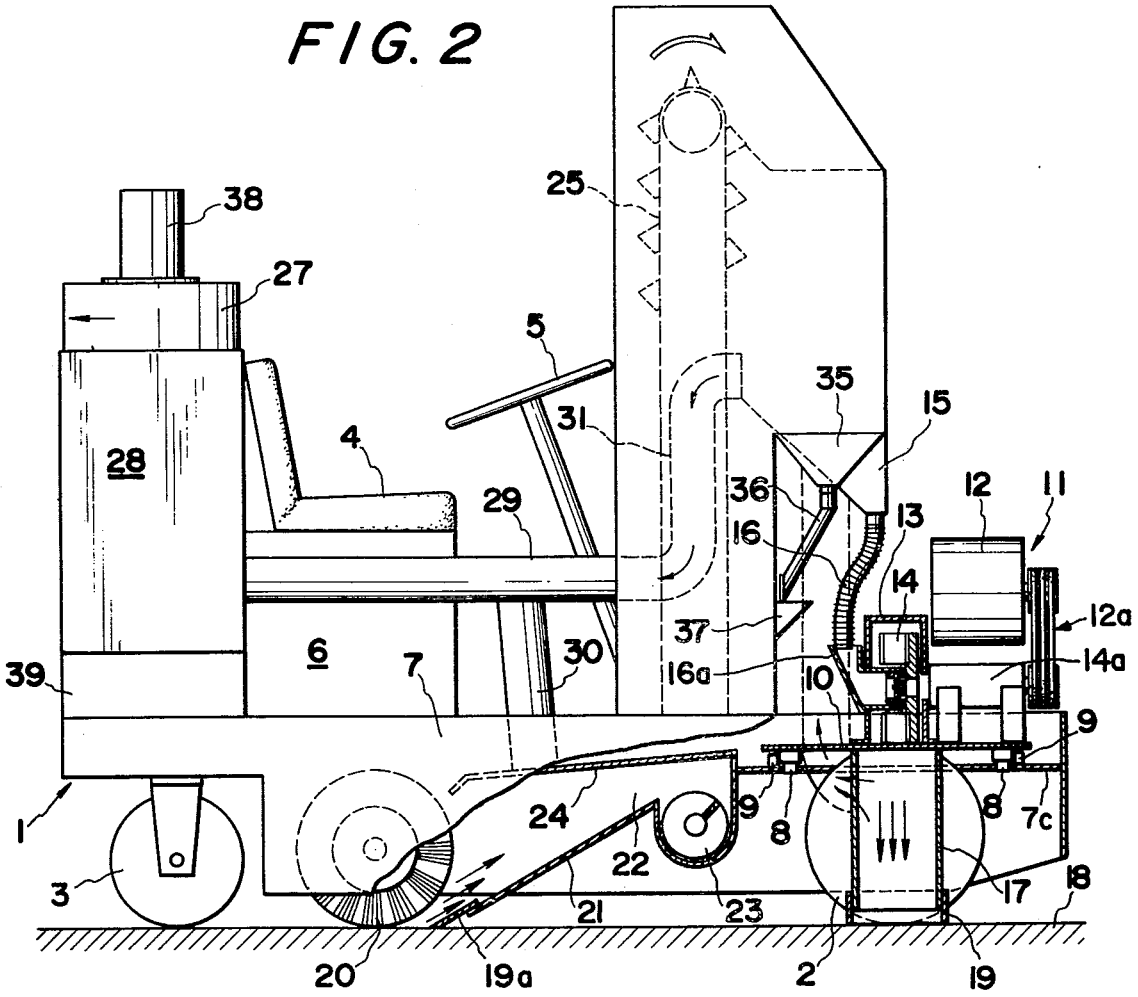
FIG. 2 is a side elevation of the same embodiment.

Referring particularly to FIGS. 1 to 3, a mobile vehicle 1 has a chassis 7 supported by front ground-engaging wheels 2 and a single rear wheel 3. Wheels 2 are connected by suitable known speed changing and reverse transmission and clutch, driven by an engine, not shown, in compartment 6 disposed beneath seat 4 for the operator. The engine may be an air-cooled four-cycle type using gasoline or diesel fuel. Since the engine, clutch and multi-speed transmission may be of conventional types, they are not shown.

A steering wheel 5 convenient for an operator on seat 4, is connected to turn rear wheel 3 for steering. The preferred operating speed for the model shown will be between about 1 and 6 meters per minute as determined by engine speed and adjustment of the transmission. The engine is also connected to drive a generator to supply current for motors subsequently described.

A turntable 10 is mounted on chassis 7 adjacent to the forward portion thereof. As is clearly shown upon FIGS. 1, 2, 4 and 5 the turntable is mounted over a circular aperture in a horizontal frame or plate **7*c* of the vehicle, for turning about a vertical axis. Thus the table is supported by four antifriction rollers 9 journaled on the under side of the turntable on respective axes radial of aperture 7*b* and equiangularly spaced about the center thereof. The rollers run smoothly in and are guided by a circular track 7*a* fixed to plate or frame 7*c* about the periphery of the aperture. Guide rollers 8** shown as four in number are journaled on the under side of the turntable and equiangularly spaced about its axis. These rotate on vertical axes and engage the rim or periphery of the aperture so that the turntable is mounted for guided rotation relatively to the chassis, about a common vertical axis of the aperture and table.

Means for the high velocity ejection of abrasive material are indicated generally at 11, FIG. 2. The ejection mechanism is mounted upon the turntable and rotates as a unit with it about the aforesaid vertical axis. This mechanism includes a motor 12 powered by the aforesaid engine-driven generator and driving an impeller 14 by means of connection **12*a* including belts and pulleys as is clear from inspection of FIG. 2. The impeller is located within an enclosure or hook fixed to the turntable and journaled for high speed rotation in bearing 14*a*** attached thereto, about a horizontal axis radially disposed with respect to the axis of the turntable.

Abrasive or like treating material is fed gravitationally downwardly from a hopper 15, through a flexible duct 16 to the impeller by which it is picked up and discharged at high velocity vertically downwardly through and along a nozzle 17. As shown upon FIG. 4 in particular, the nozzle is rectangular in horizontal section. From FIG. 3 it is noted that the nozzle diverges outwardly and downwardly in a vertical plane through its longest transverse dimension. A shroud ring 19 of rubber or like flexible material is removably secured to and about the lower periphery of the nozzle and in operation is essentially in contact with floor 18 to thereby confine the material to an area directly therebeneath.

Due to the flexibility of duct 16, discharge from hopper 15 may be effected over a range of adjustment of the turntable, of at least 90°, from a first position wherein the nozzle has its longer transverse dimension aligned with the longitudinal axis of the vehicle, to a second position wherein the axis of the nozzle is at 90° to the longitudinal axis. If the transverse length and width of the guide or shroud 17 are identified by L and W respectively, then the effective width of the area or strip treated during a single pass of the machine is $$L \sin \alpha + W \cos \alpha$$

where $\alpha$ is the dihedral angle between the dimension L and the fore-and-aft or longitudinal axis of the vehicle.

At 20, FIG. 2 is identified a cylindrical brush journaled between depending sides of the chassis for rotation about a transverse horizontal axis. The brush is located directly rearwardly of shroud 17 and contacts the floor during operating movement of the vehicle. Means not shown may be provided to raise it slightly from the floor when the vehicle or machine is not in use. It rotates in a direction opposite to travel of the machine. Rotation may be effected by mechanism such as an auxiliary clutch and take-off from the transmission driven by the vehicle's engine. Or it may be rotated by its own separate motor powered from the vehicle's generator.

A chute for the recovery of spent material ejected downwardly through nozzle 17, is indicated generally at 22, FIG. 2. This chute includes an upper plate 24, a lower plate 21 forwardly and upwardly inclined, and enclosing and interconnecting vertical side walls, right and left. The lower edge of plate 21 is somewhat spaced above the floor. The space is closed by a flexible plate or shroud **19*a*** of rubber or like flexible material.

As is clear from FIG. 2, chute 22 is formed at its top and forward end with a semi-cylindrical chamber or cross channel, which accommodates a screw conveyor rotating about a horizontal transverse axis. Drive may be by a belt or chain from the brush. Thus as the brush rotates during operation of the machine, material deposited upon the floor 18 from shroud or nozzle 17 is picked up and conducted along the chute upwardly and forwardly to conveyor 23. As the used material is fed thereby horizontally to the right end of the cross channel it is recovered by a bucket-type elevator 25, carried upwardly within the elevator housing and as best shown at FIG. 3, transferred to a chute having a particle screen 34 in its bottom wall and inclined downwardly and to the right as viewed upon that figure. Coarser particles of detritus gravitate over the surface of the screen into a hopper 35, FIGS. 2 and 3, and from there pass through a chute 36 into a separate collector chamber 37 in the base of the elevator housing. A door, not shown, gives access to the chamber for removal of the coarser detritus. Abrasive recovered by brush 20 and of a particle size capable of passing screen 34, drops back into hopper 15 for re-use.

Continuing reference to FIGS. 1, 2 and 3, a filter element is located in a compartment 28 located on the chassis over its rearward end. A centifugal-type blower 27 is secured atop the compartment and is driven by an electric motor 38 which may be direct connected with the shaft of the blower. Operation of the blower creates subatmospheric pressure in compartment 28, to draw dust-charged air through a pipe or duct 29, 31 noting FIG. 3 in particular.

The inlet of duct section 31 opens forwardly into communication with a separating chamber 33. Another branch duct 32 of the dust collecting system extends downwardly and to the right as viewed upon FIG. 3, thence vertically downwardly to an aperture in the floor of the chassis, adjacent to chute 17. Also another branch duct 30, FIGS. 1, 2 and 3, extends from communication with duct 29, downwardly to connection with an aperture in the upper plate 24 of recovery chute 22, whereby dust-impregnated air produced by rotation of brush 20, is drawn upwardly and conveyed directly to the filter in compartment 28. A small amount of extra fine particules and dust passing through screen 34 may also be drawn off from the upper portion of hopper 15, as shown at FIG. 3, and passes about a baffle 26 to chamber 33, thence to branch duct 31.

Thus there is an almost complete recovery of detritus including material blasted down shroud 17 as well as matter scoured from the surface being cleaned or otherwise treated. The greater portion of coarse material, incapable of passing screen 34, is collected separately, while particles too small for practicable re-use pass through duct 29 and accumulate in the filter in compartment 28. Material capable of re-use passes directly back to hopper 15. FIGS. 2 and 3 show that elevator 25 is disposed at one side of the chassis where it does not obscure the forward view of an operator on seat 4.

Figure 4:
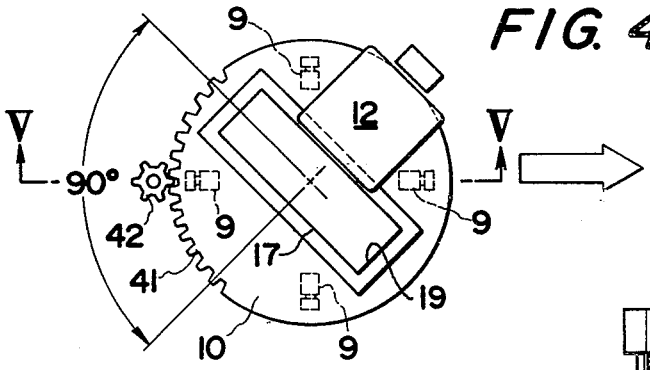
FIG. 4 is a detail plan view of the turntable supporting the projecting nozzle and means for effecting rotative adjustments thereof.
Figure 5:
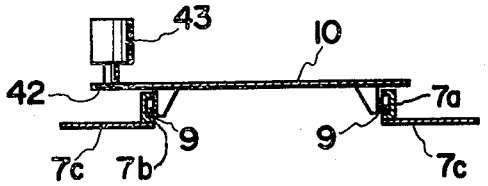
FIG. 5. is a detail section taken in a plane identified by line V–V, FIG. 4.

A control panel 40, FIG. 1, is mounted forwardly of steering wheel 5, for convenient maniplulation by the operator, of control switches and levers thereon. FIGS. 4 and 5 show details of means for angularly adjusting turntable 10. The periphery of the table is toothed over a little more than 90°. The teeth mesh with a pinion 42 driven by a reversible motor 43. The control and reversing switches located on panel 40 provide an accurate and convenient means of adjusting the table to any desired angular position with respect to the longitudinal or fore-and-aft axis of the chassis. If preferred, manual adjusting means may replace those shown.

The operation of the form of the invention just described will in general be obvious from the foregoing and may be briefly resumed as follows:

With the engine in compartment 6 energized and a charge of abrasive in hopper 15, the operator energizes motor 43 to adjust turntable 10 so that the longer dimension L of the discharge opening of nozzle 17 makes a selected or desired angle with the longitudinal axis of the chassis. Where the job involves merely the erasure of a stripe as from a pavement, the angle will be zero in which case as is clear from the previously-stated trigonometrical expression the transverse width of the area treated will be that of dimension W of the discharge opening. On the other hand when the entire area of a floor or deck is to be surfaced, the angle selected will be 90° in which case the dimension L will be at right angles to the longitudinal axis of the chassis and the machine is set to surface a strip of maximum width. Of course any adjustment between 0° and 90° may be selected as particular conditions of use may dictate, as where a painted strip must be erased from a pavement and having a width greater than W. By way of illustration applicant has found dimensions of W and L to be about 155 and 45 cm., respectively, to be satisfactory for general use.

Figure 6:
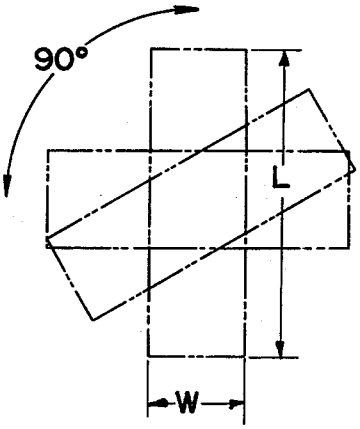
FIG. 6 is a schematic plan view illustrating the principle employed in varying the effective width of a strip of surface treated during one pass of the machine.
Figure 9:
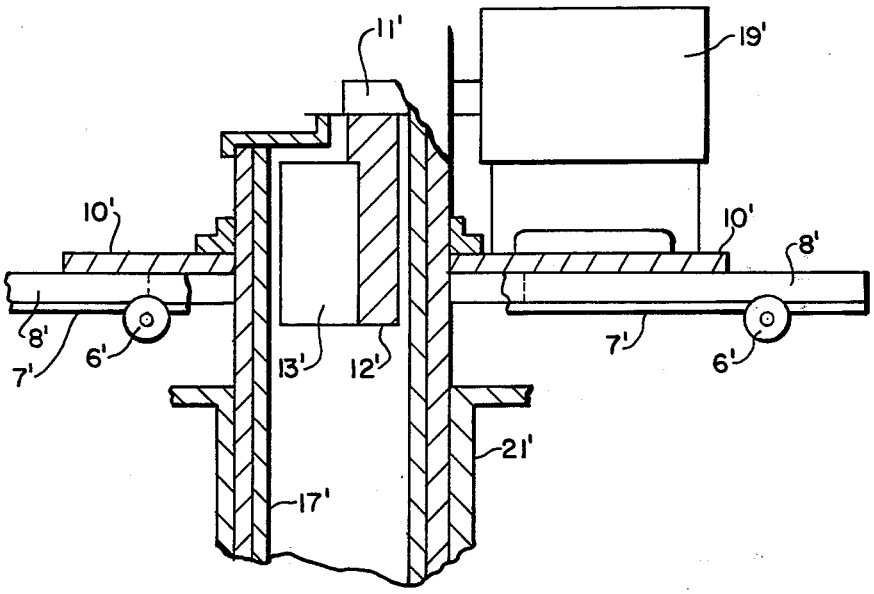
FIG. 9 is an enlarged view of the turntable of FIG. 7 supporting the impeller, drive motor and nozzle for rotation on the frame, there being an aperture in the frame for the nozzle. Track means for translation of the frame are also shown.

At the starting location motors 12 and 38 are energized and the machine is propelled in the desired direction. Abrasive or other treating material is directed at high velocity downwardly through nozzle 17 against the floor, whereby rubber, paint, rust, scale or other substances are scoured off. The detritus is picked up by brush 20 and propelled up chute 22 into conveyor 23 thence to elevator 25, and screened at 34. Small particles are returned to the hopper 15 for re-use while larger particles are collected in box 37 and periodically dumped. Dust is drawn off through ducts 30 and 32 and conveyed by suction to and through the filter element in compartment 28, for periodical disposal. Thus substantially all detritus and dust are recovered and confined, and almost none escapes to ambient air. Thus the stated objects of the invention are achieved economicaly and efficiently. FIG. 6 shows in dot-dash lines the two limiting adjustments of nozzle 17, as well as one intermediate position.

Under some conditions of use it is found that the scale or rust is too thick or too adhesive in limited spots or areas, to be removed by a single pass of the machine thereover. In such instance, while as in the invention shown upon FIGS. 1 to 5 it is possible to reverse the direction of travel of the entire machine, it is very convenient, useful, and time saving in the completion of a satisfactory job, to be able to translate the turntable, nozzle and other parts mounted thereon, relatively to the chassis in the direction of travel. In this way repeated passes over limited spots or areas ae possible with the machine at rest or even while it is moving slowly forwardly. For this purpose I have provided a form of the invention shown upon FIGS. 7 and 8. Referring in detail to those figures, the chassis 2' is supported by a rear driving wheel 3' and at its forward end by two steering wheels 4' articulated to axle A. Propelling power is conveyed to wheel 3' from a motor 5', by a chain or belt in a way clear from inspection of FIG. 7.

A number of V-rollers 6' are journaled on the chassis along each longitudinal side thereof. These guide rollers on each side are aligned in the longitudinal direction, for rotation above respective axes disposed transversely of the machine. The rollers act collectively to guide a frame 8' for translation in the fore-and-aft direction, by means of two rails 7' V-shaped in transverse section and secured to the under side of the frame at the respective side edges thereof.

The frame has a central opening through which projects the shroud or nozzle 17'. The nozzle has a plate or turntable 10' externally secured thereto and which rests on the frame at the periphery of the opening therein, thus enabling the nozzle and its impeller, subsequently described, to be adjusted through a selected angle about a vertical axis passing centrally in and along the nozzle. Suitable guide means, not shown, such as rollers 8 and 9 of FIGS. 1, 2 and 4, guide the turntable for smooth rotational adjustment as previously described in connection with the model of FIGS. 1, 2, etc.

Reciprocation of plate 10' and frame 8' as a unit, as well as nozzle 17', is effected by a double-acting air or hydraulic cylinder 9' attached to the under side of the frame and having therein a piston connected with rod **9*a***, secured at its exterior end to the chassis. By control valve means not shown, pressure fluid can be introduced to either end of the cylinder and simultaneously exhausted from its other end, to oscillate or translate the frame, turntable and nozzle, back and forth in the direction of travel of the vehicle.

Figure 7:
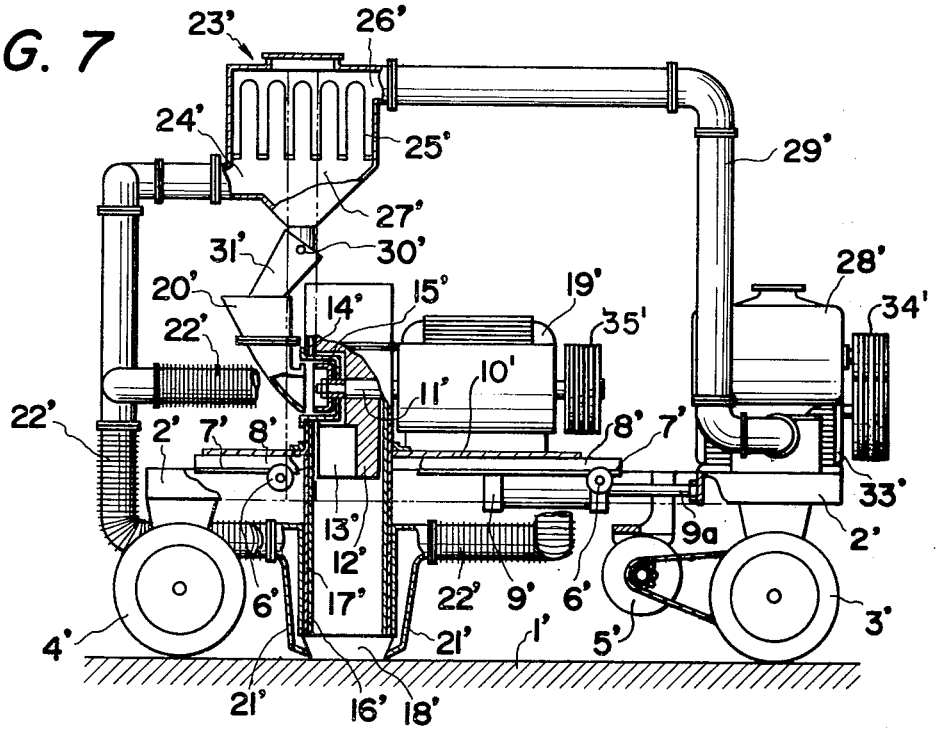
FIG. 7 is a side elevation partly in section, of another form of the invention wherein in addition to width adjustment of the strip of surface being treated, the nozzle may be oscillated in the direction of travel of the machine, as where special or repeated treatment is required of a particular or limited area, either with the machine temporarily at rest or moving in and along the direction of its longitudinal axis.

Turntable 10' is of a size sufficient to mount a motor 19' having its shaft connected to drive shaft 11' of an impeller 12' through belt and pulley connection 35', FIG. 7. As shown the impeller has radially disposed blades 13'. There is also provided a smaller and inner impeller 15' attached to the end of shaft 11'. The impeller is located within the upper portion of nozzle 17' which has its rectangular discharge opening indicated at 18', FIG. 7.

Figure 8:
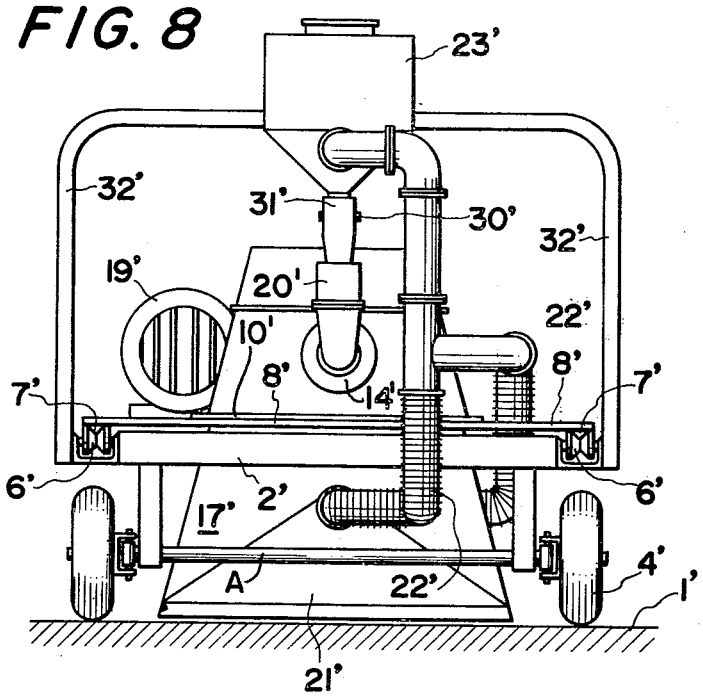
FIG. 8 is a front elevation of the machine of FIG. 7.

Abrasive is conveyed to and along the axis of the impeller by a chute 20', first picked up by impeller 15', thrown radially outwardly and directed by blades 13' at accelerated velocity downwardly through the nozzle. Abrasive material stored in hopper 23' flows gravitationally downwardly to and through a chute 31' universally pivoted to the discharge spout of the hopper. As shown by FIG. 8, hopper 23' is supported over the chassis by a frame 32' of inverted "U" shape. Due to the universal connection of chute 3' with the discharge spout of the hopper, material can be fed to chute 20' throughout the range of angular adjustment of turntable 10' and nozzle 17', it being noted that these chutes are closely adjacent the vertical axis of adjustment, so that the total distance of arcuate travel is small. Nozzle 17' is lined with a removable liner 16' of neoprene or like sheet material. This protects the metal of the nozzle against excessive wear. The lining may be in one piece and removably held in place for ready replacement.

A skirt or hood 21' surrounds the lower portion of nozzle 17' in closely-spaced fixed relation therewith. This hood at its top is in communication with exhaust ducts which, as shown, include flexible sections 22' permitting the described rotational and/or translational movements of the nozzle. At the left of FIG. 7 it is shown that one exhaust duct extends upwardly and rearwardly to communication with chamber 24' of the hopper. A like duct connection, a potion of which is broken away in FIG. 7 to avoid obscuration of impeller mechanism, includes flexible portions 22'. FIG. 8 shows this duct section extending to the right, upwardly and forwardly to connection with the main duct to chamber 24'.

A motor 33', FIG. 7, is mounted upon the rear end of the chassis and by a pulley and belt connection 34' drives a scavenging pump or blower 28' located above and to one side of the motor. The suction or intake of the pump is connected to a secondary port 26' intercepted by a bag filter and a cyclone 25', whereby dust is separated and collected so that filtered air only is drawn off by the pump. The filter element is removable through a covered opening in the top of the hopper casing. Coarser particles thrown off by the cyclone are impelled thereby into the lower part of the hopper, for gravitational re-circulation through chutes 31' and 20'. Current may be supplied to motors 5', 19' and 33' from an external source through a flexible cable and switches on a control panel not shown, fixed on the chassis. It is also contemplated that the machine of FIGS. 7 and 8 may be provided with its own engine-generator set as in FIGS. 1 to 5, to supply electric energy. Also the chassis of this machine may have a seat for an operator and steering means for front wheel 4'.

The operation is essentially like that previously described for FIGS. 1 to 5. Motor 5' is energized to propel the machine on and along a surface to be treated. With motors 19' and 33' in operation, abrasive is projected at high speed, downwardly through nozzle 17' and against the surface. Detritus is picked up through hood 21', drawn into the hopper, separated into dust and coarser particles. Dust is filtered and collected while the coarser particles are impelled into the base of the hopper.

When a local spot or area is particularly resistant to cleaning, motor 5' may be de-energized and the control valve not shown is operated to introduce pressure fluid alternately into the ends of cylinder 9', to thus translate frame 8' and parts supported thereby, forwardly and rearwardly to thus effect any necessary number of re-passes over the local area until it is thoroughly cleaned. This may also be accomplished while the machine is being advanced slowly by variable speed motor 5'. Since this motor is also reversible it is also possible to effect re-passes by moving the entire machine back and forth.

As in the case of the machine of FIGS. 1 to 5, turntable 10' can be rotated manually or by power, through a selected angle, to vary the effective width of the strip of surface treated in a single pass of the machine.

The foregoing disclosure is to be taken in an illustrative rather than a limiting sense. For numerous modifications, substitutions of equivalents, refinementsand re-arrangement of parts will become obvious to those skilled in the art, after a study of the foregoing specification.

I claim:

1. In a mobile surface cleaning and polishing machine, a chassis having a longitudinal axis, ground-engaging wheels journaled to said chassis for supporting the same for translation in the direction of said axis, said chassis including a horizontal plate having a central opening therethrough, a turntable, means mounting said turntable on said plate for limited turning about a vertical axis normal to said plate, over said opening, a nozzle having a generally rectangular discharge orifice, said nozzle being fixedly mounted on said turntable to depend therefrom, with said discharge orifice closely spaced from and above a surface to be treated, a reservoir for abrasive material carried by said chassis, an impeller journaled on said turntable and rotatable to impel material from said reservoir through said nozzle, to and out of said orifice, and power means carried by said chassis, connected to rotate said impeller, a cylindrical brush journaled on said chassis for rotation on a horizontal axis extending transversely of said chassis, and engageable with a surface being treated, rearwardly of said nozzle, an upwardly-inclined chute having an intake opening contiguous to said brush and including a channel at its top transversely of said longitudinal axis, conveyor means in said channel operating to convey to one end thereof, material impelled by said brush, elevator means cooperating with said conveyor means, to elevate accumulated material for flow by gravity into said reservoir, a compartment mounted on said chassis and adapted to contain a filter element for dust, a blower connected to exhaust air from said compartment, a main duct conducting air from said reservoir to said compartment for filtering dust therein, and a branch duct connected between said chute and said main duct.

2. The machine of claim 1, said power means comprising a motor mounted on said turntable for movement as a unit therewith, and power transmission means connecting the shafts of said impeller and motor.

3. The machine of claim 1, said wheels including first and second forward laterally-spaced wheels, said vertical axis of said turntable intersecting the common axis of rotation of said first and second wheels.

4. The machine of claim 1, said elevator means depositing material at a level above said reservoir, a screen receiving material at said level, from said elevator means, and inclined downwardly over said reservoir to pass thereto material up to a predetermined particle size, and a chamber forming means carried by said chassis in position to receive from said screen, material of a particle size greater than said predetermined size, for accumulation therein.

5. The machine of claim 1 said reservoir having a discharge spout above the level of said impeller, and a flexible tubular duct connecting said discharge spout with said impeller, for gravity flow of material thereto.

6. The machine of claim 1, said impeller being journaled for rotation about an axis horizontally parallel with said turntable, and a casing directing material from the outlet of said duct, directly to said impeller and along said last-named axis.

7. The machine of claim 1, said power means being a motor fixed on said turntable, and pulley and belt driving connections between said impeller and said motor.

8. The machine of claim 1, said ground-engaging wheels including front right and left laterally-spaced driving wheels rotating on a common axis fixed transversely of said longitudinal axis, the vertical axis of said turntable substantially intersecting said common axis, said power means comprising a motor mounted on said turntable with its shaft connected to said impeller, a third and steering wheel journaled to said chassis beneath the rear end thereof, said motor and blower being mounted atop said compartment.

9. The machine of claim 1, and guide means mounting said plate, turntable and on said chassis for positive limited guided translation as a unit, parallel with said longitudinal axis.

10. The machine of claim 9, and means comprising a hydraulic cylinder fixed with said plate and having a piston rod attached to said chassis for so translating said plate, turntable and nozzle.

11. The machine of claim 9, a hood fixed with and surounding said discharge orifice in closely-spaced relation therewith, a first duct communicating at its respective ends with said hood and reservoir, and including a section of flexible suction hose, a power-driven suction pump mounted on said chassis, and a second duct connecting the intake of said pump with said reservoir.

12. The machine of claim 11, said casing having a material-discharge spout closely adjacent the vertical axis of said turntable, a first chute fixed with said turntable to conduct material to said impeller contiguous to said impeller and along the axis of rotation thereof, a second chute conducting material from said spout to said first chute, and a universal joint connection between the inlet of said first chute and said spout.

13. A machine for cleaning and polishing floors and other surfaces, comprising, a chassis having a longitudinal axis, floor-engaging wheels journaled to said chassis for supporting the same for translation in the direction of said axis, a frame, first means mounting said frame on said chassis for limited positively-guided translation in the direction of said axis, a nozzle having a central vertical axis and a downwardly-directed discharge opening, second means rotatably mounting said nozzle on said frame with said discharge opening closely adjacent to the surface to be treated, third means connected between said chassis and frame to oscillate the frame in said direction, a reservoir for material, mounted on said chassis above said nozzle, an impeller mounted to be intersected by said vertical central axis, power means connected with said impeller to drive the same and direct material at high speed through said nozzle and out of said discharge opening, duct means conducting material from said reservoir to said impeller, and means on said chassis to propel the same in said longitudinal direction.

14. The machine of claim 13, said discharge opening having mutually normal, horizontal, greater and lesser dimensions, said second means including a turntable fixed with said nozzle and adjustable as a unit therewith about said central vertical axis for varying the angular relation between said dimensions and said longitudinal axis.

15. A machine for cleaning and polishing floors and other surfaces according to claim 13, wherein said second means includes a turnable so mounted on said frame as to rotate as an unit around the central vertical axis for varying its angular relation to the moving direction of said machine and the width of floor to be treated.

16. A machine for cleaning and polishing floors and other surfaces according to claim 13, said third means further includes tracks fixed to the under side of the frame, grooved rollers mounted on said chassis in which the tracks run, as presented N M power cylinder means connected to said frame;

a piston within said cylinder, a rod connected with the piston extending from said cylinder and connected with said chassis to oscillate said frame along said longitudinal axis.

* * * * *